US012295404B1

(12) United States Patent
Sinclair, Jr.

(10) Patent No.: US 12,295,404 B1
(45) **Date of Patent: *May 13, 2025**

(54) SMOKING ARTICLE AND METHOD

(71) Applicants: Blunt Wrap U.S.A., Inc., Mandeville, LA (US); NORTH ATLANTIC WRAP COMPANY LLC, Louisville, KY (US)

(72) Inventor: Daniel S. Sinclair, Jr., Mandeville, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/444,986

(22) Filed: Feb. 19, 2024

Related U.S. Application Data

(63) Continuation of application No. 18/178,850, filed on Mar. 6, 2023, now Pat. No. 11,903,408, which is a continuation of application No. 17/165,796, filed on Feb. 2, 2021, now Pat. No. 11,819,048, which is a continuation of application No. 16/416,364, filed on May 20, 2019, now Pat. No. 10,905,153, which is a continuation of application No. 15/821,795, filed on Nov. 23, 2017, now Pat. No. 10,292,417, which is a continuation of application No. 15/070,554, filed on Mar. 15, 2016, now Pat. No. 9,826,776, which is a continuation of application No. 14/847,935, filed on Sep. 8, 2015, now Pat. No. 9,282,765, which is a continuation of application No. 13/267,096, filed on Oct. 6, 2011, now Pat. No. 9,125,435.

(60) Provisional application No. 61/390,257, filed on Oct. 6, 2010.

(51) Int. Cl.

| | |
|---|---|
| ***A24C 3/00*** | (2006.01) |
| ***A24C 1/02*** | (2006.01) |
| ***A24C 1/38*** | (2006.01) |
| ***A24C 5/46*** | (2006.01) |
| ***A24D 1/00*** | (2020.01) |
| ***A24D 1/02*** | (2006.01) |
| ***A24D 1/04*** | (2006.01) |
| ***B65B 5/04*** | (2006.01) |
| ***B65B 19/26*** | (2006.01) |

(52) U.S. Cl.
CPC ..... *A24C 3/00* (2013.01); *A24C 1/02* (2013.01); *A24C 1/38* (2013.01); *A24C 5/46* (2013.01); *A24D 1/008* (2013.01); *A24D 1/022* (2013.01); *A24D 1/042* (2013.01); *B65B 5/04* (2013.01); *B65B 19/26* (2013.01)

(58) Field of Classification Search
None
See application file for complete search history.

*Primary Examiner* — Phu H Nguyen
(74) *Attorney, Agent, or Firm* — Roy Kiesel Ford Doody & North, APLC; Brett A. North

(57) ABSTRACT

A method of constructing a cigar includes the providing of a plurality of frusto-conically shaped tubes, each tube being of a smokable material such as a spirally wrapped layer of tobacco material. The tubes are nested, one tube inside the other tube. The nested tubes are then attached to a mouthpiece having a socket that is internally threaded. The nested tubes and mouthpiece are packaged either filled with tobacco filler material, partially filled, or unfilled in a container.

26 Claims, 11 Drawing Sheets

SMOKING ARTICLE AND METHOD

CROSS-REFERENCE TO RELATED APPLICATIONS

This is a continuation of U.S. patent application Ser. No. 18/178,850, filed February Mar. 6, 2023 (now U.S. Pat. No. 11,903,408), which is a continuation of U.S. patent application Ser. No. 17/165,796, filed Feb. 2, 2021, which is a continuation of U.S. patent application Ser. No. 16/416,364, filed May 20, 2019 (now U.S. Pat. No. 10,905,153), which is a continuation of U.S. patent application Ser. No. 15/821,795, filed Nov. 23, 2017 (now U.S. Pat. No. 10,292,417), which is continuation of U.S. patent application Ser. No. 15/070,554, filed Mar. 15, 2016 (now U.S. Pat. No. 9,826,776), which is a continuation of U.S. patent application Ser. No. 14/847,935, filed Sep. 8, 2015 (now U.S. Pat. No. 9,282,765), which is a continuation of U.S. patent application Ser. No. 13/267,096, filed Oct. 6, 2011 (now U.S. Pat. No. 9,125,435), which is a nonprovisional/claims the benefit of U.S. Provisional Patent Application Ser. No. 61/390,257, filed Oct. 6, 2010, the entirety of each of which applications and/or patents are incorporated herein by reference. Priority to/of each of these applications and/or patents is hereby claimed.

BACKGROUND OF THE INVENTION

At One embodiment relates to an improved method of fabricating a cigar. More particularly, one embodiment relates to an improved method of fabricating a cigar that provides a frusto-conically shaped smoking article that can be dissembled into multiple covers for preparing additional cigars, enabling a smoker to add his or her custom tobacco to one or more of the cones.

One embodiment relates to smoking articles, snuff, chewing tobacco, and other smoking and dipping product including flavor release inserts or encapsulated flavor beads. While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

The following U.S. patents relate to methods of making cigars and cigar articles, each listed patent hereby incorporated herein by reference:

TABLE

| PATENT NO. | TITLE | ISSUE DATE |
|---|---|---|
| 6,321,755 | Tobacco product and a method of making thereof | Nov. 27, 2001 |
| 6,357,448 | Tobacco product | Mar. 19, 2002 |
| 6,526,986 | Tobacco product | Mar. 4, 2003 |
| 6,742,525 | Tobacco product | Jun. 1, 2004 |
| 6,854,471 | Tobacco product | Feb. 15, 2005 |
| 7,543,590 | Intermediate wrapper and method of making | Jun. 9, 2009 |
| 7,571,730 | Cigar Tube | Aug. 11, 2009 |

SUMMARY OF THE INVENTION

One embodiment provides an improved method of constructing a cigar. In one embodiment the method provides a plurality of frusto-conically shaped or conically shaped tubes or cones. Each cone or tube can be a smokable material such as tobacco material and can be a spirally wrapped layer of tobacco material.

In one embodiment each cone or tube can have proximal and distal end portions, each having an opening.

In one embodiment the method can include nesting of one cone or tube inside the other cone or tube.

In one embodiment is provided a mouthpiece is provided having a socket that is internally threaded. The mouthpiece can be removably attached to the proximal end of the nested tubes. The connection of a mouthpiece or tip to the nested cones or tubes can be a threaded connection.

The nested tubes and mouthpiece are placed in a package or container, such as a shipping package or container or storage package or container. A smoker can remove the nested tubes and separate them to fabricate multiple new cigars using his or her custom tobacco filler material.

In one embodiment, the nested cones or tubes are partially filled.

In one embodiment, at least one of the cones or tubes is serrated.

In one embodiment, at least one of the cones or tubes is serrated along a line that extends proximally to distally.

In one embodiment, a cone or tube is provided with a flap or tab that can be detached and/or attached, thus enabling a user to enlarge the proximal end opening after removal from the container.

In one embodiment, a rod is placed inside the nested cones or tubes for enabling a user to compact his or her custom tobacco filler material in the cone or tube after removal from the package.

In one embodiment, the container can be cylindrically shaped.

In one embodiment, the container can be conically shaped.

In one embodiment, the container can be a package with a flat portion.

In one embodiment, at least one cone or tube has a closure tab that can be opened for enabling a smoker to open a cone or tube by manipulating the tab.

In one embodiment, at least one cone or tube has a closure tab that closes the cone or tube with adhesive on the tab. The tab is opened, the smoker expanding the cone or tube and then closing the cone or tube using the closure tab.

In one embodiment, the tab is in between the end portions of the tube.

In one embodiment, the tab is at the distal end portion of the tube.

In one embodiment, the tubes are removed from the package, enabling the forming of multiple new cigars by disassembling the tubes. A smoker forms multiple new cigars using a tube for each new cigar and a smoker's custom tobacco as a filler material.

In one embodiment, two new cigars are formed.

In one embodiment, is provided a smoking article having a storage container with an open end portion and an interior. A cap removably attaches to the container at the open end portion. At least a pair of cones can be nested one inside the other, each cone having a proximal opening and a distal opening.

In one embodiment is provided a mouthpiece which attaches to the nested cones, the mouthpiece having internal threads that threadably engage one of the cones. In one embodiment at least one of the cones is expandable to provide a larger diameter distal opening.

In any of the described embodiments is provided a method of offering for sale a customizable tobacco product comprising the steps of providing a packaged tobacco product, offering for sale the tobacco product, the tobacco product including instructions for making a finished tobacco product. In various embodiments the instructions are one or more steps shown in the individual embodiments for making a finished cigar.

BRIEF DESCRIPTION OF DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
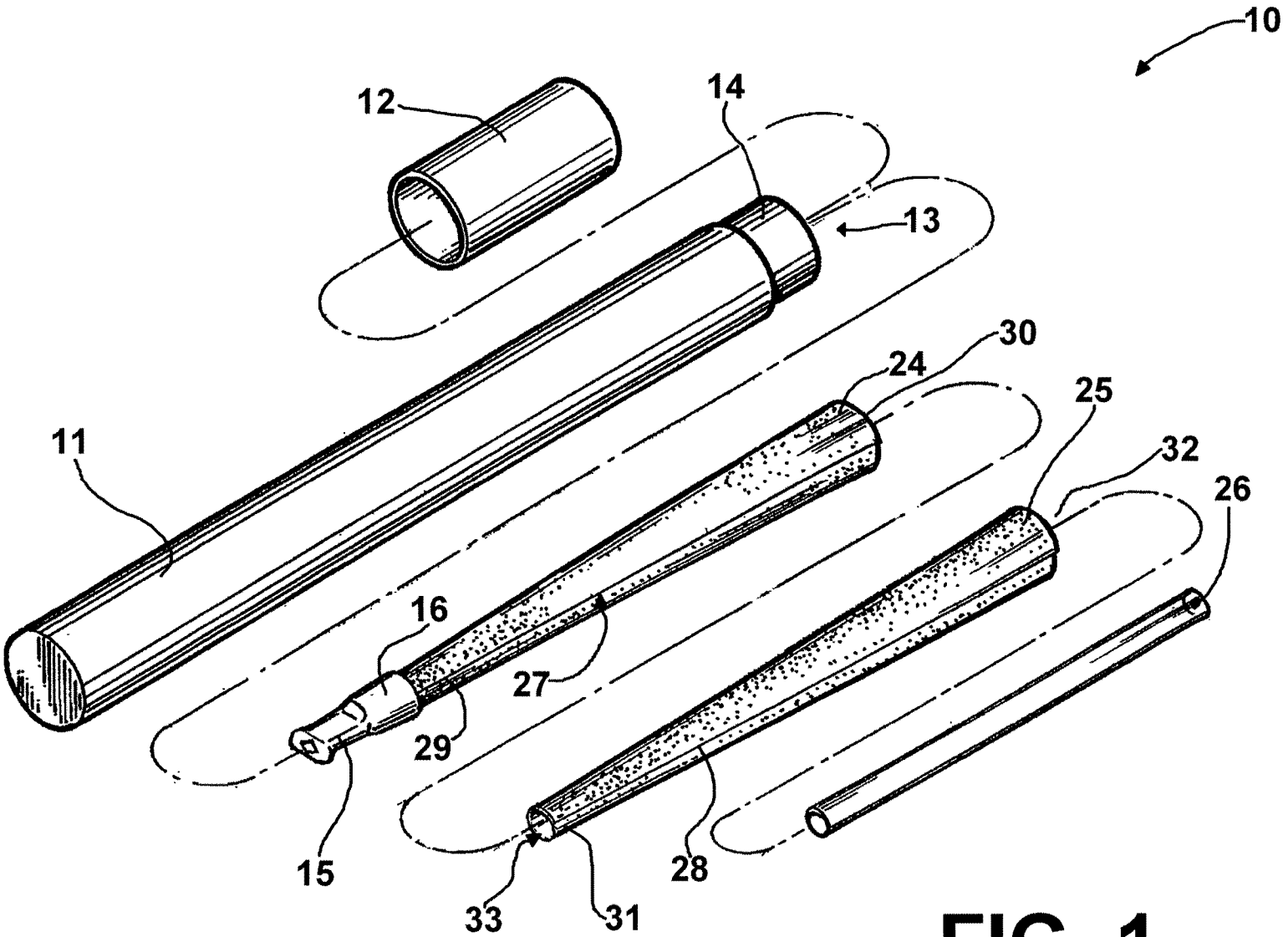
FIG. 1 is shows an exploded perspective view of a cone with a tip and straw and all of which are placed in a storage tube.

FIGS. 1-7 show one embodiment of the method and apparatus designated generally by the numeral 10. In FIGS. 1-7, smoking article 10 is shown as initially packaged in a storage tube or container 11. Container 11 has a closure or cap 12. The container 11 has an interior 13 for containing a smoking article that includes tip or mouthpiece 15, cones 24, 25, and rod or straw 26. The container 11 has narrowed or smaller diameter section 14 which is receptive of cap or closure 12.

Figure 2:
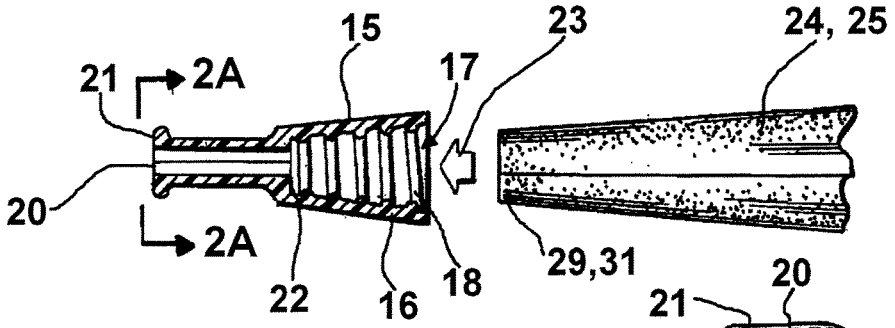
FIG. 2 shows a cone being threaded into a tip (the tip being shown in sections).
Figure 2A:
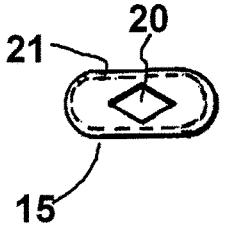
FIG. 2A is an end view of the tip where the tip is viewed from the lines 2A-2A of FIG. 2.

Tip or mouthpiece 15 is shown in FIGS. 1, 2 and 2A. In one embodiment mouthpiece 15 can receive first and second frusto-conically shaped layers or cones 24 and 25.

In FIGS. 2 and 2A, tip or mouthpiece 15 can have a distal frusto-conical section 16 with a socket 17 that is internally threaded. Internal threads 18 enable a user to threadably engage a first or a second frusto-conically shaped layer or cone 24, 25 of tobacco material. Alternatively, both frusto-conically shaped layers or cones 24, 25 can be placed one inside the other and the two assembled to mouthpiece 15 by inserting the layers or cones 24, 25 in the direction of arrow 23 into socket 17 and then rotating layers or cones 24, 25 while inserting proximal end 29, 31 into socket 17.

Tip or mouthpiece 15 has an airway 20 that can have a diamond shaped cross section as shown in FIG. 2A. Shoulder 21 is provided on tip or mouthpiece 15 for helping a user to hold the proximal section 19 of tip or mouthpiece 15 in his or her mouth. Stop 22 is provided at the distal end of airway 20 as shown in FIG. 2. The stop 22 limits penetration of the frusto-conically shaped layers or cones 24, 25 into socket 17. In one embodiment airway 20 can be a square or diamond shaped.

Figure 3:
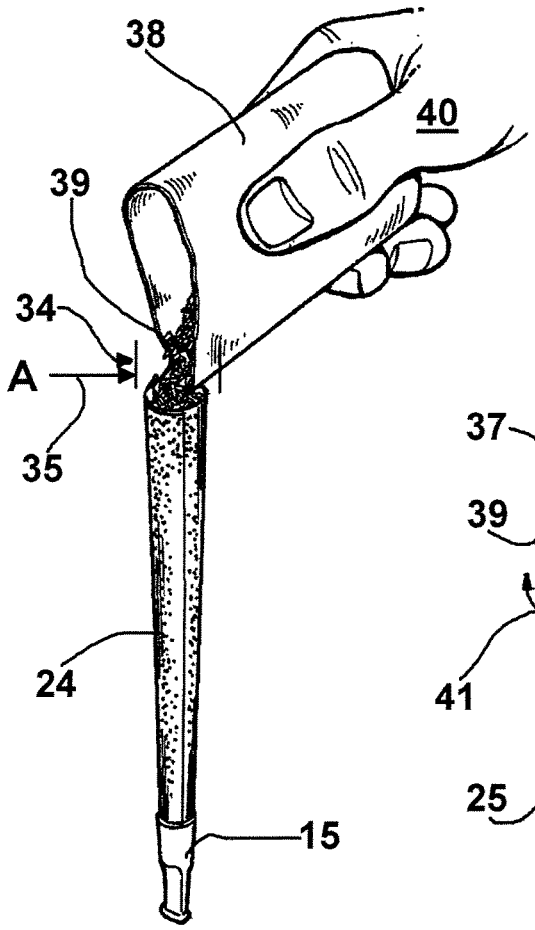
FIG. 3 is a perspective view of the cone and tip of FIG. 1 being filled with a tobacco filler of choice where the large section of the cone has a small diameter A.
Figure 4:
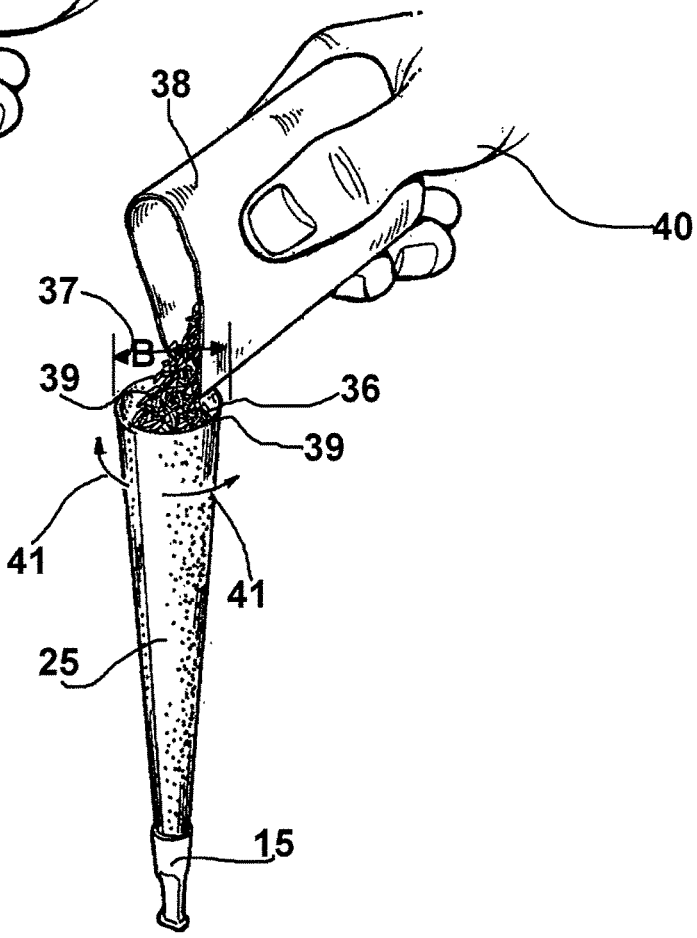
FIG. 4 is a perspective view of the cone and tip of FIG. 1 being filled with a tobacco filler of choice where the large section of the cone has a larger diameter B, the larger diameter B being obtained by removing cone from the tip, enlarging the cone diameter by partially unwrapping the cone, and placing again enlarged cone in tip.
Figure 5:
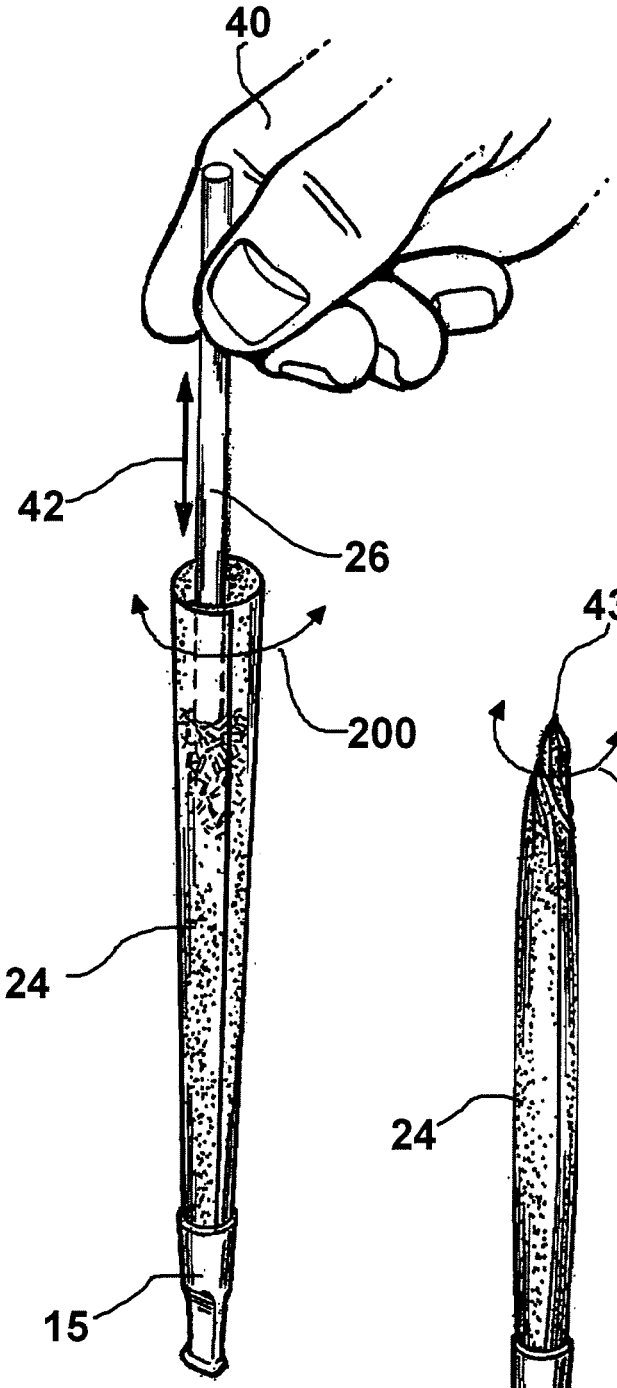
FIG. 5 is a perspective view generally showing cut tobacco or tobacco filler being compacted in a cone using a straw.

A rod or straw 26 can be used to compress a user's tobacco after the user's tobacco filler material 39 has been added to either one of the frusto-conically shaped layers or cones 24, 25 as shown in FIGS. 3, 4 and 5.

Each of the layers or cones 24, 25 has an edge that is exposed. Otherwise, each of the layers or cones 24, 25 is spirally wrapped. In FIG. 1, frusto-conically shaped layer or cones 24 has edge 27. Frusto-conically shaped layer or cone 25 has edge 28. Each of the frusto-conically shaped layers or cones 24, 25 has a proximal end and a proximal opening. Layer 24 has proximal end 29 with an opening and distal end having distal opening 30. Similarly, second frusto-conically shaped layer 25 has distal opening 32 and proximal opening 33 at end 31.

In FIG. 3, a smaller diameter opening 34 is shown, indicated by arrow 35 for the dimension A. In FIG. 4, a larger diameter opening 36 is shown, indicated by dimension arrow 37 for dimension B. In order to expand the opening, a user removes the tip or mouthpiece 15. The user then enlarges the cone 24 or 25 at the distal opening, from smaller diameter opening 34 to larger diameter opening 36. The user then replaces the tip 15 by rotating the tip 15 while inserting the cone 24 or 25 proximal end 29 or 31 into the tip 15 socket 17. A user can expand or contract the selected frusto-conically shaped layer 24, 25 to achieve the smaller diameter opening 34 of FIG. 3 or the larger diameter opening 36 of FIG. 4. In either case, a smoker 40 selects his or her custom tobacco 39 in package 38. The smoker adds that tobacco material 39 to either the frusto-conically shaped layer 24 or 25 and through either a smaller diameter opening 34 or larger diameter opening 36 of FIG. 3 or 4.

In FIG. 3, a smoker 40 is shown emptying custom tobacco material 39 from package 38 into frusto-conically shaped layer 24 via smaller diameter opening 34. In FIG. 4, smoker 40 dispenses tobacco material 39 from package 38 into frusto-conically shaped layer 25 via larger diameter opening 37. In FIG. 4, arrows 41 illustrate schematically the expansion of the distal opening 36 to the diameter B indicated by arrow 37. In FIG. 5, the smoker 40 employs rod or straw 26 to compress the tobacco material 39 that was added to the selected frusto-conically shaped layer 24 or 25 in combination with a tip or mouthpiece 15 as illustrated by arrow 42 in FIG. 5.

Figure 6:
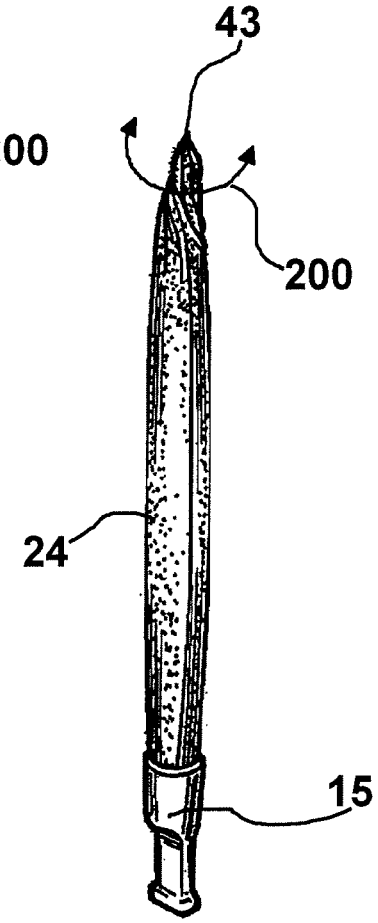
FIG. 6 shows a finished cigar after the enlarged tip of the cone in FIG. 5 has been twisted closed.

In FIG. 6, a twisted closure 43 is used to close the open end or opening 34 or 36 to provide the completed or finished cigar which includes a selected frusto-conically shaped layer 24 or 25, mouthpiece 15 and tobacco filler material 39. Arrows 200 in FIGS. 5 and 6 schematically indicate the twisting action used to close twisted closure 43.

Figure 7:
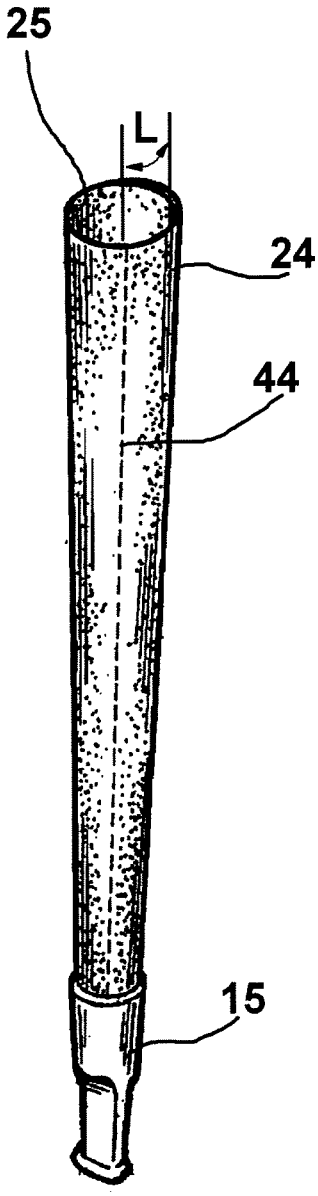
FIG. 7 shows an alternative embodiment of a cone where the side of the cone has been perforated for ease of opening.

FIG. 7 shows an alternate construction for cone or frusto-conically shaped layer 24 or 25. In FIG. 7, the side of the cone or section 24 or 25 has been perforated at longitudinal perforation 44 for ease of opening.

In one embodiment spirally wrapped layer 24 can spirally and internally extend beyond longitudinal perforation line 44 a length L (as indicated in FIG. 7). In one embodiment layer 25 can also include a longitudinal perforation line 44' with layer 25 extending spirally and internally beyond longitudinal perforation line 44' a length L. In various embodiments the extent of extension L can be about ⅛, ¼, ⅓, ½, ¾, and 1 inch. In various embodiments the extension can be between about any two of the above specified lengths. In various embodiments layer 24 can be glued (such as a longitudinal glue line on the opposite side of perforation line 44—compared to extension of length L). Similarly layer 25 can be glued.

Figure 8:
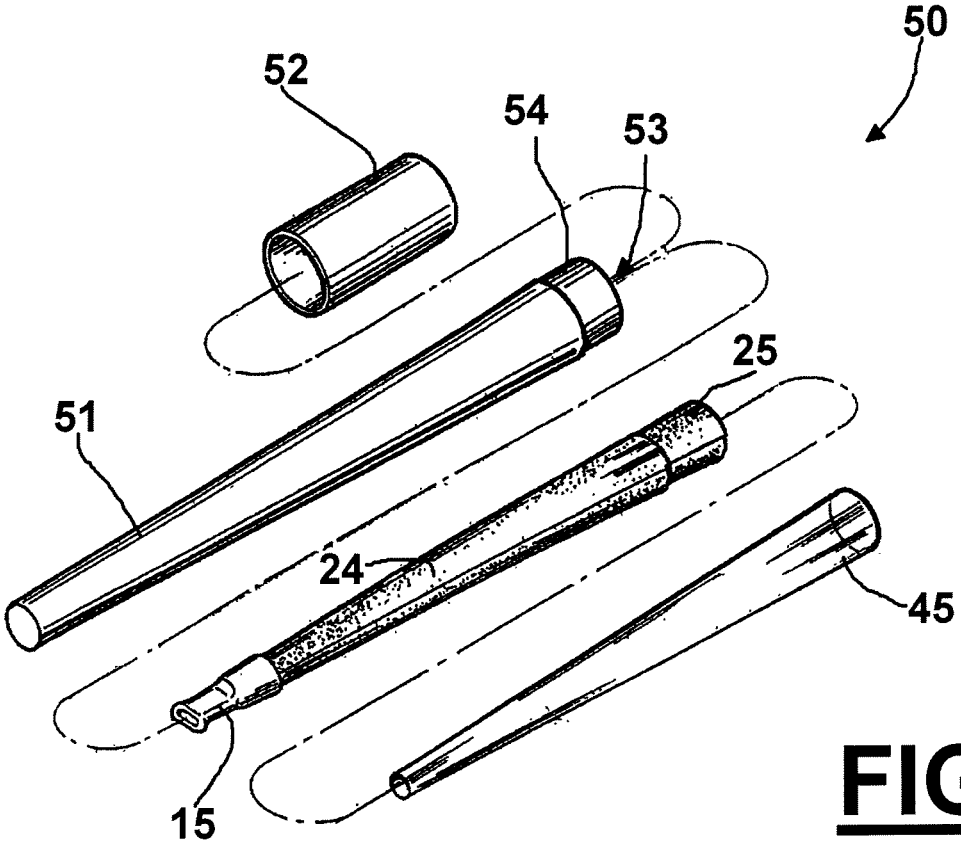
FIG. 8 shows an alternative embodiment where the exterior storage tube and interior supporting member are both tapered substantially the same as the taper of the cone.

FIG. 8 shows another alternative embodiment of the apparatus of the present invention, designated generally by the numeral 50. In FIG. 8, an exterior storage tube or container 51 and interior supporting member 45 are tapered with substantially the same taper as of the cones 24, 25. In FIG. 8, the storage tube 51 is conically or frusto-conically shaped and can be closed with a cap or closure 52. The cap or closure 52 is preferably fitted to a narrowed or smaller diameter section 54. Smoking article 50 of FIG. 8 provides an interior 53 of the storage tube 51 for housing one or more cones 24, 25 fitted to tip 15. In FIG. 8, the cones 24, 25 can be reinforced internally with interior supporting member 45. The member 45 can be conically shaped as shown.

Figure 9:
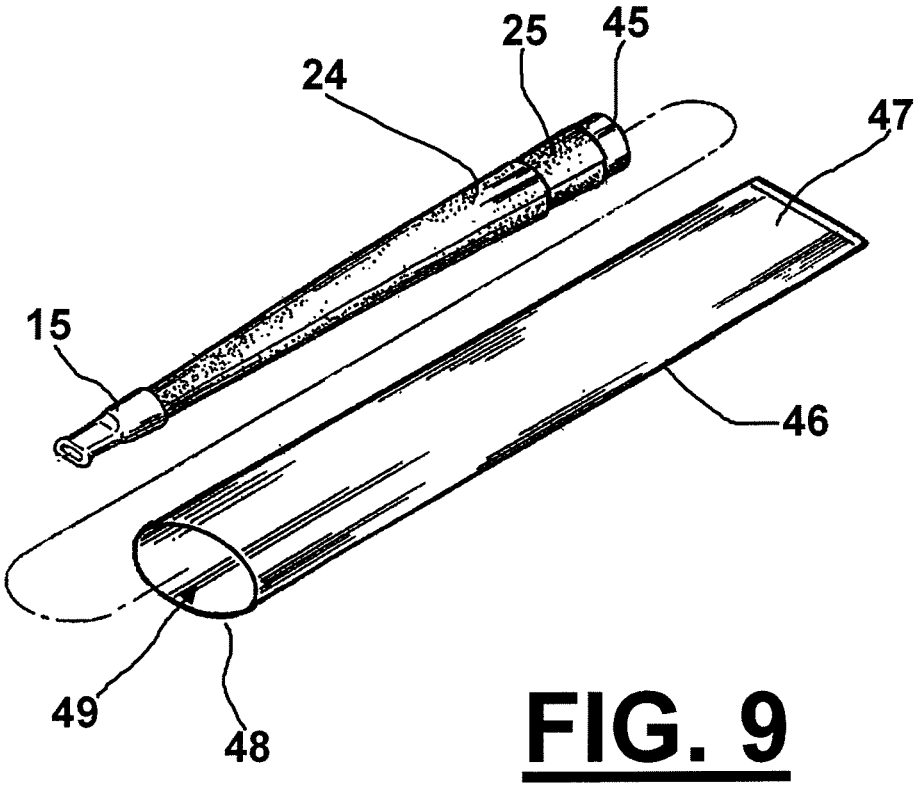
FIG. 9 shows a cone with tapered interior supporting member being packaged for sale in a pouch.

FIG. 9 illustrates a cone or cones 24, 25 with a tapered interior supporting member 45 being package in a pouch 46. The pouch 46 can provide a flat end portion 47, circular opening 48 and interior 49.

FIGS. 10-13 show an alternative embodiment of the apparatus of the present invention, designated generally by the numeral 55. In the alternative arrangement of FIGS. 10-13, a detachable connecting tab 60 is provided for assisting a smoker 40 to widen the diameter of the enlarged distal end from a smaller diameter designated as A in FIG. 10 to a larger diameter that is designated as B is FIG. 12. In one embodiment detachable connecting tab 60 can include a detachable adhesive or glue on surface 60' to allow detachment and re-attachment of tab 6 when adjusting diameters. In FIGS. 10-13, smoking article 55 can include one or more spirally wrapped layers 56, each having a distal end portion 57 and a proximal end portion 58.

Figures 10, 11, 12, 13:
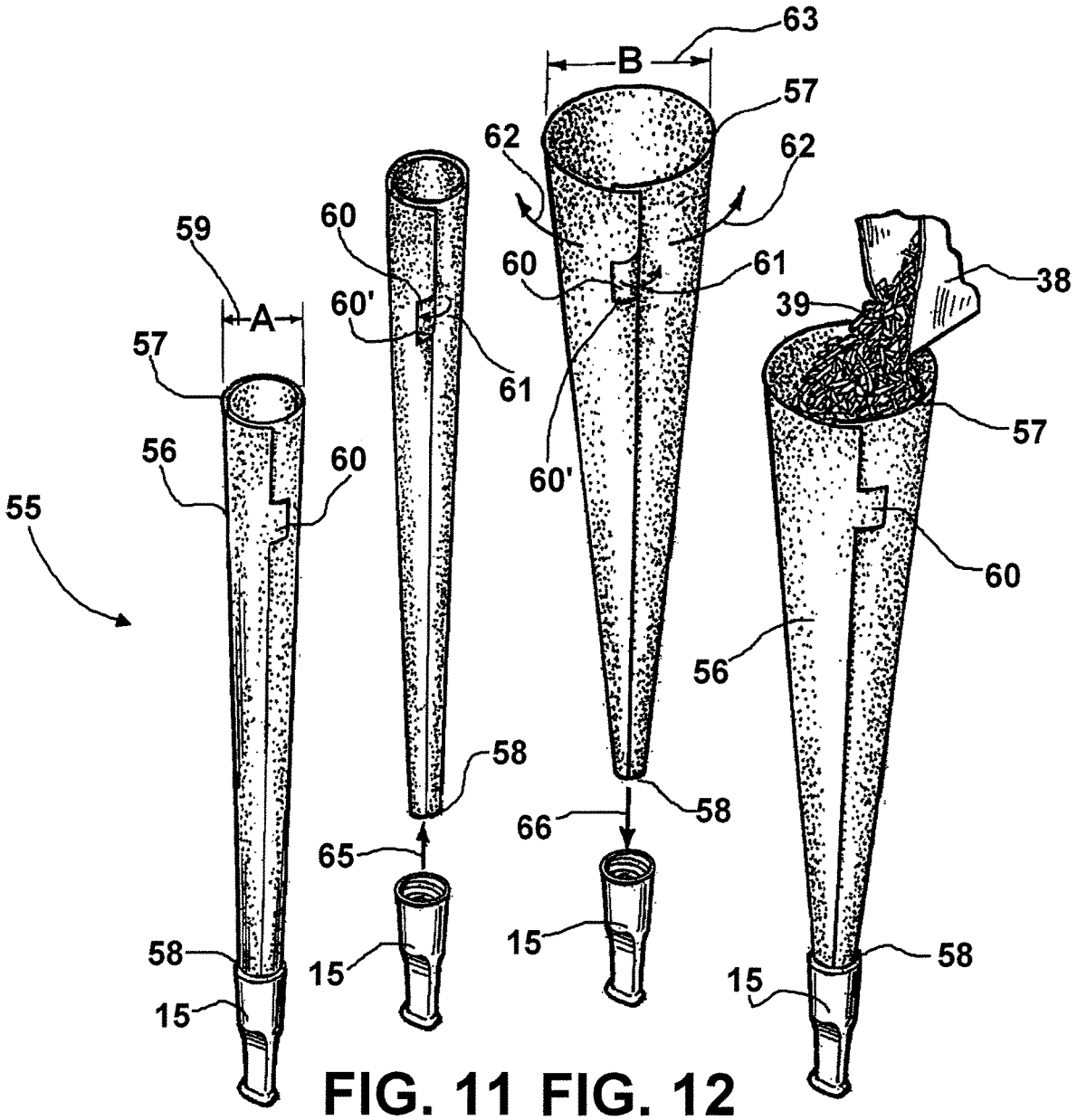
FIGS. 10 through 13 show an alternative cone having a detachable connection tab and schematically illustrate the steps of using the tab in widening the diameter of the enlarged end from a diameter of A to a larger diameter of B.

In FIG. 10, arrow 59 illustrates a diameter of dimension A which is a smaller diameter distal opening. In FIG. 10, closure tab 60 is provided with a light adhesive material for holding the cone or spirally wrapped layer 56 in the position shown in FIG. 10. In FIG. 10, the diameter at distal end portion 57 is smaller, namely that of arrow 59 dimension A. In FIG. 11, layer or cone 56 is separated from tip 15 as illustrated by arrow 65 in FIG. 11. In FIG. 11, the closure tab or connection tab 60 is disconnected as illustrated by arrow 61. Once the tab 60 is separated from the remaining part of spirally wrapped layer or cone 56, the distal end 57 can be enlarged (arrows 62) to the dimension B illustrated by arrow 63 in FIG. 12. The tab 60 is then closed as illustrated by arrow 64 in FIG. 12. Because the tab 60 has a light adhesive material, it reattaches itself to the layer or cone 56 after the distal end 57 has been expanded to the dimension B illustrated by arrow 63. This expansion is also illustrated by the arrow 62 in FIG. 12. In FIG. 13, the user adds his or her tobacco filler 39 from pouch 38 to the interior of cone 56 having the now expanded distal opening. Arrow 66 illustrates reattachment to tip 15. In one embodiment tip 15 can be screwed onto cone 56.

Figures 14, 15, 16, 17:
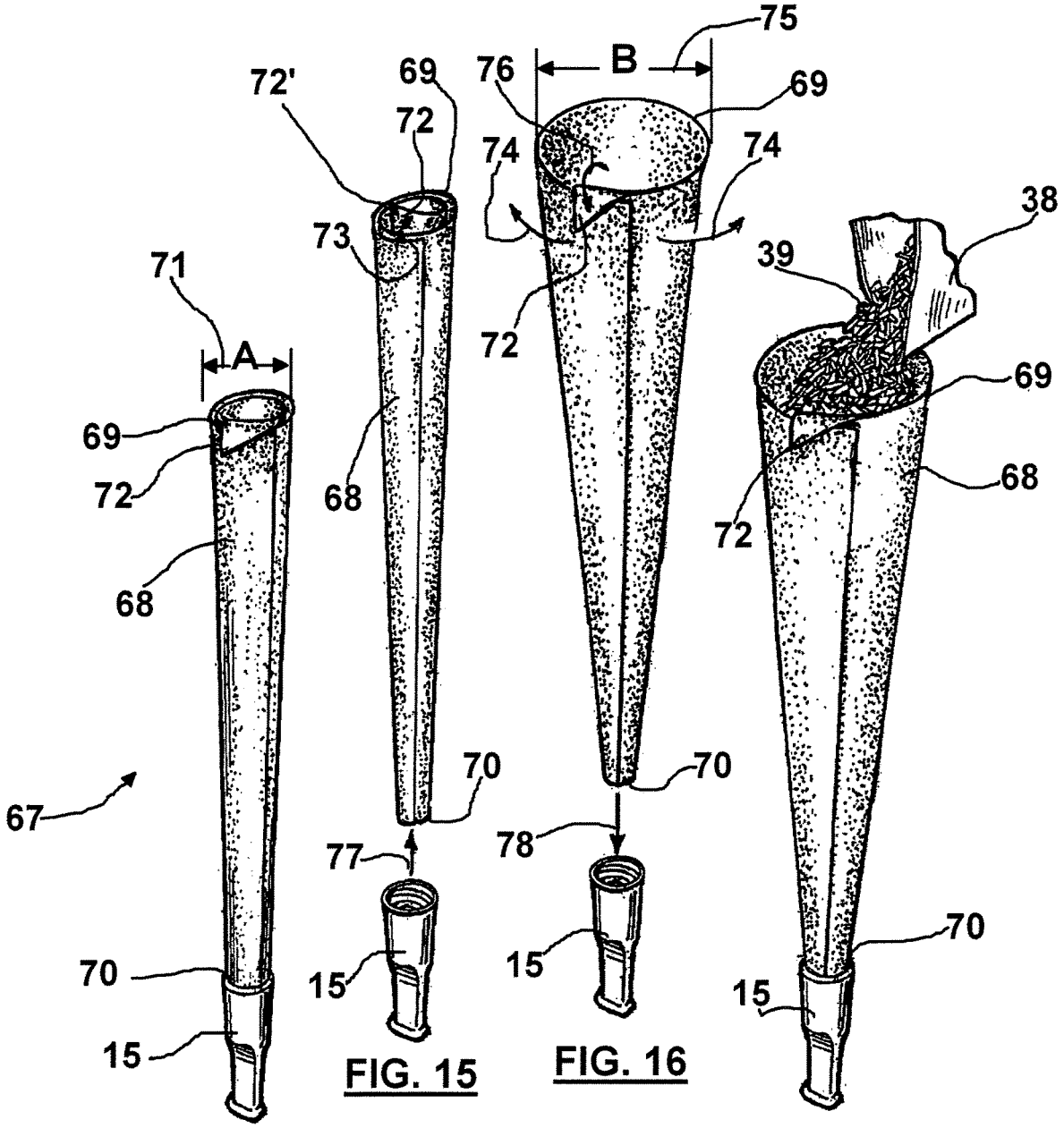
FIGS. 14 through 17 show an alternative cone having a detachable connection flap and schematically illustrate the steps of using the flap in widening the diameter of the enlarged end from a diameter of A to a larger diameter of B.

FIGS. 14-17 show an alternative cone arrangement having a detachable connection flap and also are illustrating the steps of using the flap 72 to widen the diameter of the distal end portion from a smaller diameter A illustrated by arrow 71 in FIG. 14 to a larger diameter B illustrated by arrow 75 in FIG. 16. FIGS. 14-17 thus also illustrate an alternative method for making or fabricating a cigar. In FIGS. 14-17 and 22-23, smoking article 67 includes a spirally wrapped layer or cone 68 that has a conical or frusto conical shape. Cone 68 has distal end portion 69 and proximal end portion 70. In FIG. 14, arrow 71 illustrates a first diameter A which is a smaller diameter for the distal end portion 69 of cone 68. In FIG. 14, flap 72 is in a closed position, holding the cone 68 in a smaller diameter configuration shown. In FIG. 15, arrow 73 illustrates a disconnection of flap 72 from the remaining part of cone 68. After this disconnection of flap 72, the cone 68 can be expanded as illustrated by arrows 74 in FIG. 16. The expanded distal end portion 69 now has a diameter B illustrated by arrow 75 in FIG. 16. Arrow 77 in FIG. 15 illustrates a disconnection of the cone 68 from tip or mouthpiece 15 prior to expansion while the arrow 78 in FIG.

16 illustrates a re-attachment of the cone 68 to the mouthpiece of tip 15 after expansion of the distal end portion.

FIG. 17 illustrates the addition of a smoker's custom tobacco filler material 39 from pouch 38 into the expanded cone 68. FIG. 17 also illustrates the reattachment of the flap 72 to the remaining part of cone 68. As with the embodiment of FIGS. 10-13, the flap 72 provides an adhesive portion which enables it to be reattached after it has been disconnected, the distal end 69 expanded, and the new diameter B illustrated by arrow 75 obtained. Arrow 76 in FIG. 16 illustrates this reattachment of flap 72 to the remaining part of cone 68.

Figures 18, 19, 20, 21:
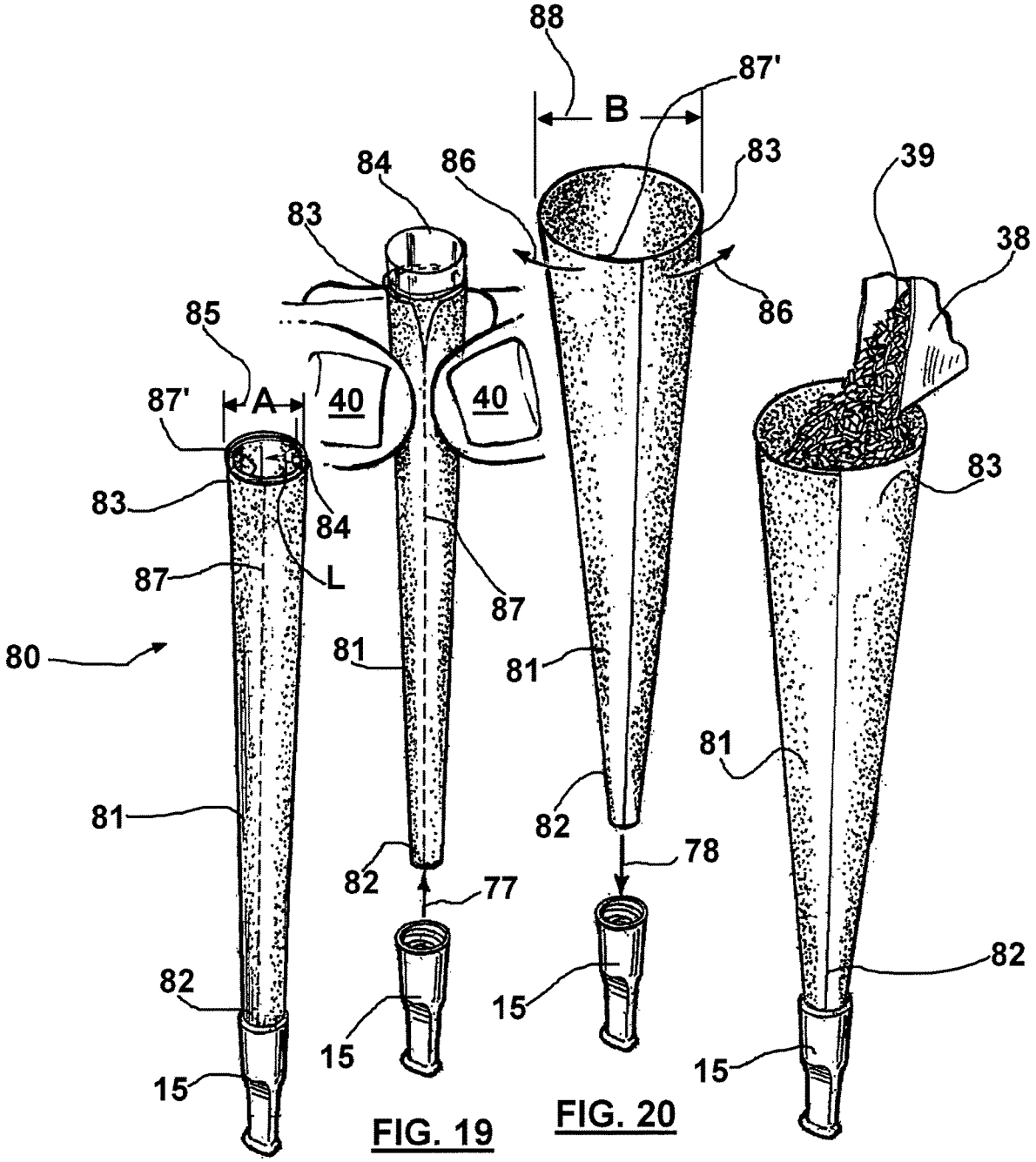
FIGS. 18 through 21 show an alternative cone having an adjusting longitudinal perforation line and schematically illustrate the steps of using the perforation line in widening the diameter of the enlarged end from a diameter of A to a larger diameter of B.

FIG. 18-21, shows another alternate embodiment of the apparatus of the present invention, designated generally by the numeral 80. Smoking article 80 has a tip or mouthpiece 15 connected to a cone or spirally wrapped, conically shaped layer 81. Layer or cone 81 has proximal end 82 and distal end 83. The cone or layer 81 can be internally supported with conically shaped support member 84. The end 83 can be enlarged by first tearing or rupturing the perforation 87 and the expanding end 83. In FIG. 18, end 83 has a smaller diameter A indicated by arrows 85. In FIG. 19, perforation 87 is torn. In FIG. 20, arrows 86 indicate that end 83 has been expanded to a new diameter B, indicated by arrows 88.

Figures 22, 23, 24, 25:
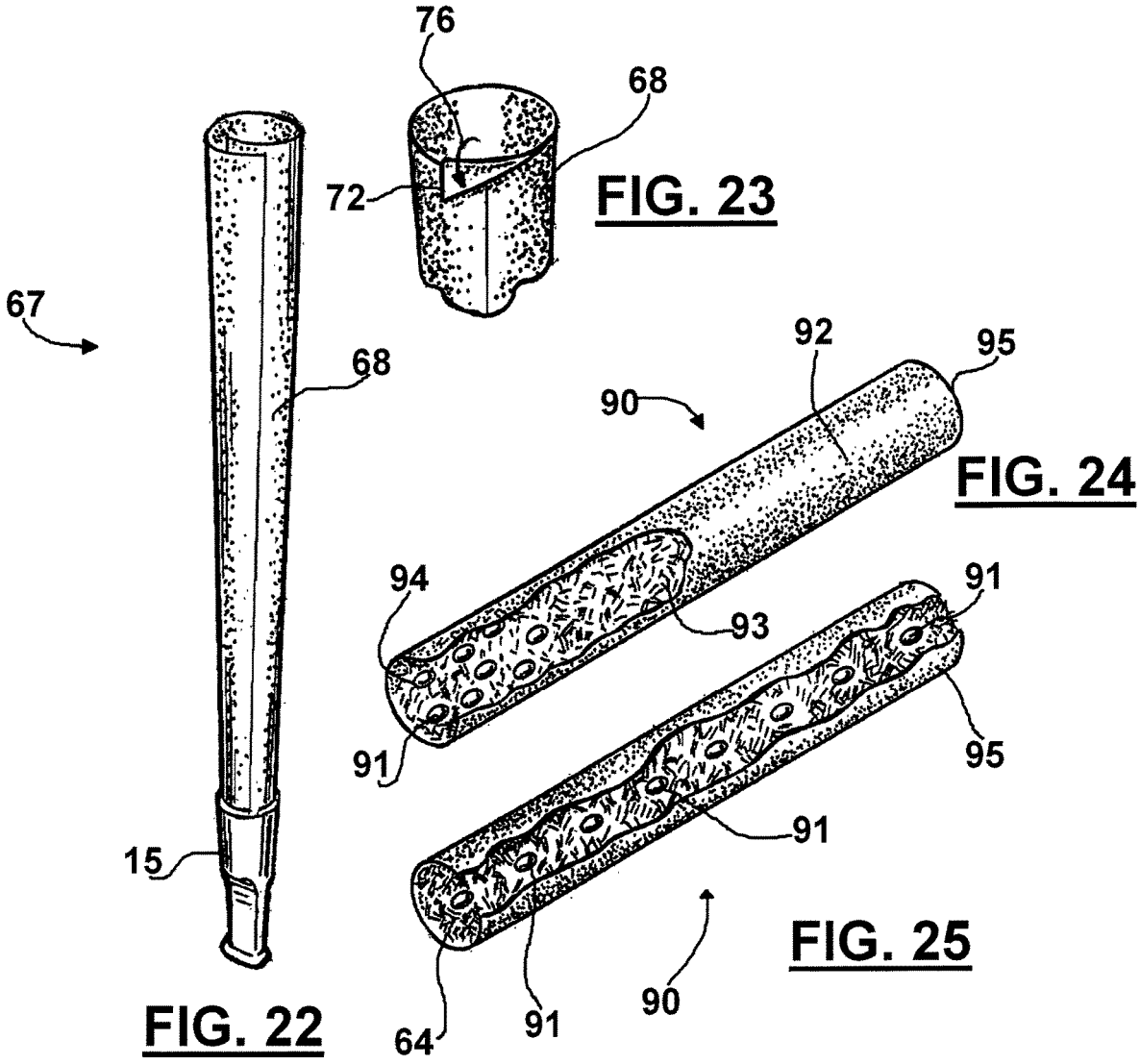
FIGS. 22 and 23 schematically show the steps of detachably connecting the adjusting flap of the embodiment shown in FIGS. 14 through 17.
FIGS. 24 and 25 show alternative embodiments of burstable flavoring elements which can be located on one end of a finished cigar or spaced about the longitudinal length of a finished cigar.
Figure 26:
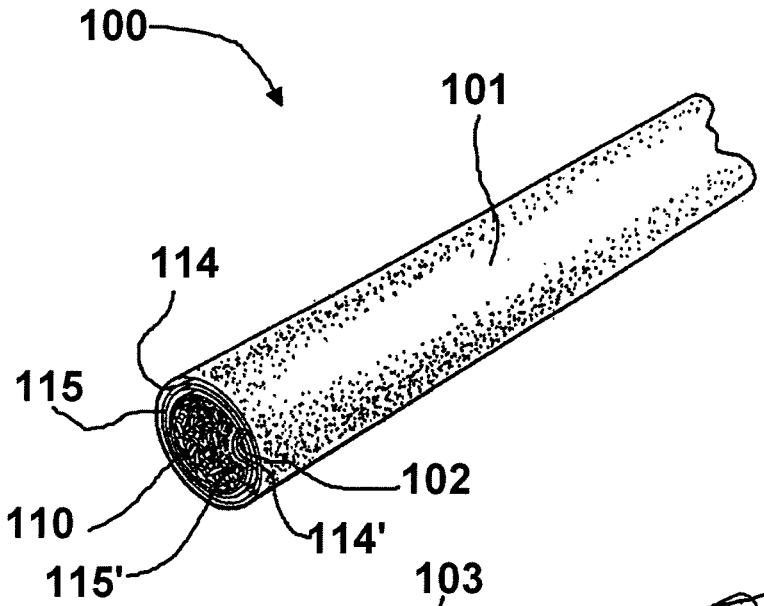
FIG. 26 shows an alternative embodiment of a finished cigar with multiple detachably connected sheets wrapped about its exterior and a plurality of these sheets having detachment strings which can be pulled to cause a particular sheet to have two (2) longitudinal edges and being capable of being removed from the finished cigar.

In FIGS. 24-25, a smoking article 90 has one or more outer tobacco layers 92 surrounding filler 93. Filler 93 contains burstable flavor elements 91. In FIG. 25, the flavor elements 91 are spaced equally along the layer 92 and between the ends 94, 95. In FIG. 24, the elements are concentrated near end 94.

FIGS. 26-30 show another embodiment of the apparatus of the present invention designated generally by numeral 100. Smoking article 100 has layers 101, 1114, 115 that can each be cut longitudinally with their respective string or cable 102, 114', 115' as illustrated by arrow 103 in FIG. 27 for string 102. The layers 101, 114, 115 are encasing finished tobacco product 110.

Figure 27:
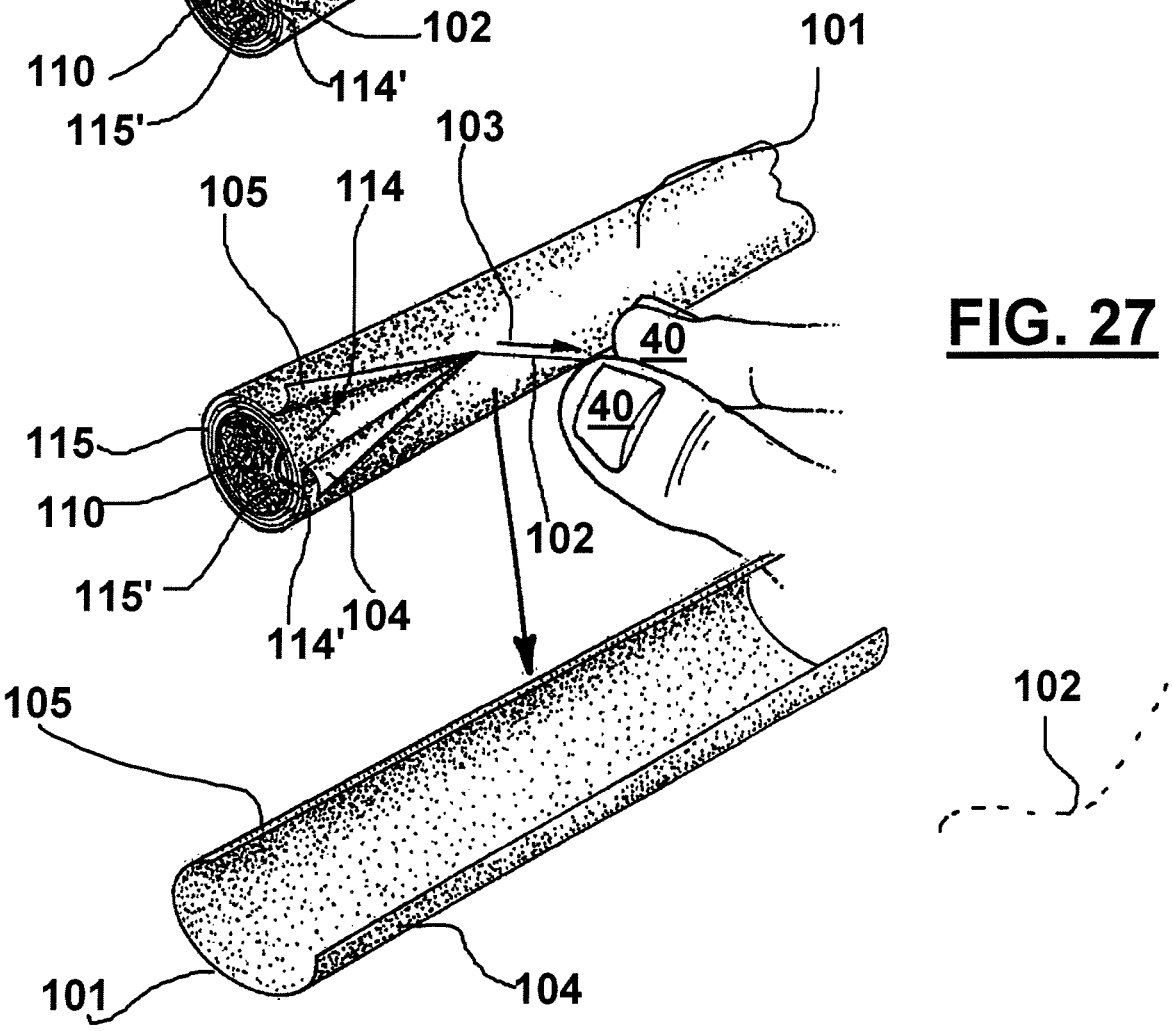
FIG. 27 shows one sheet being removed from the finished cigar and having a rolling memory after being removed from the finished cigar.

As indicated in FIG. 27, once a layer 101 is cut with string 102, edges 104, 105 are produced. After being cut, a selected layer 101 has a memory as seen in FIG. 27. The opened layer 101 (or 114 or 115) can then be filled with a smoker's custom tobacco filler material as indicated in FIG. 30 to make a finished cigar or cigarette.

Figure 28:
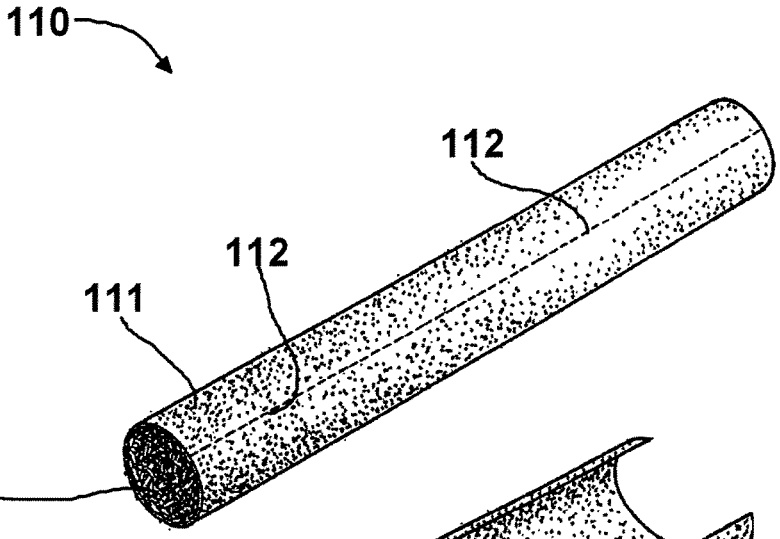
FIGS. 28 and 29 show three sheets that have been removed from the finished cigar (by pulling off their respective detachment strings) and each of the removed sheets having a rolling memory, along with the finished cigar remaining in the core where the finished cigar has a longitudinal perforation along its wall to facilitate access to the interior bore.
Figure 29:
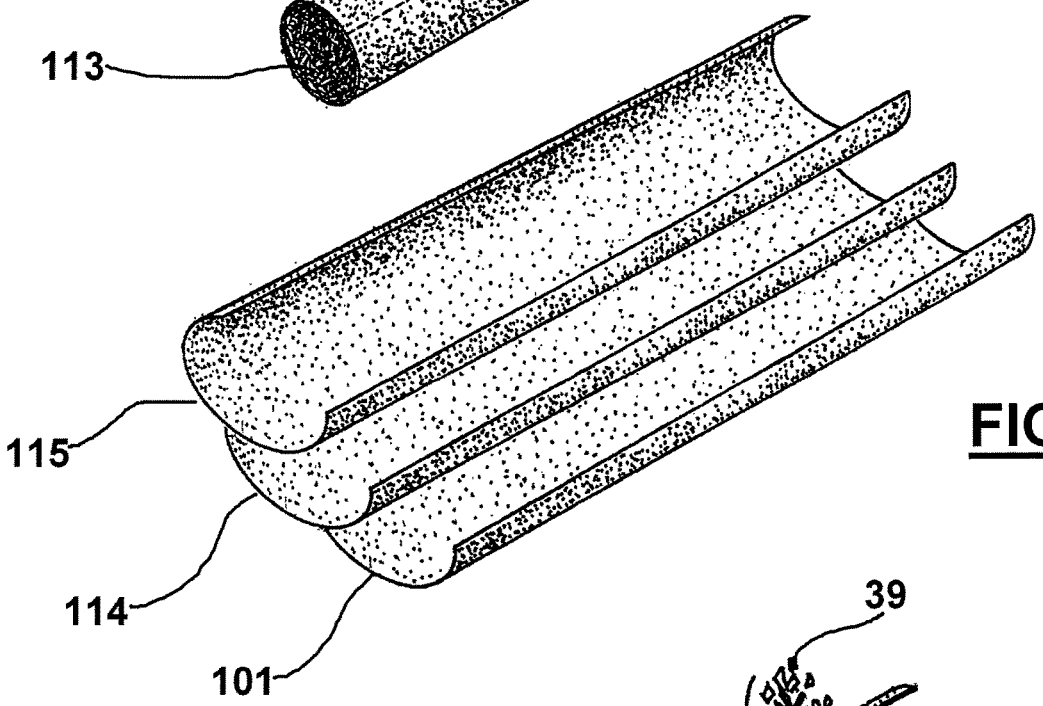
Figure 30:
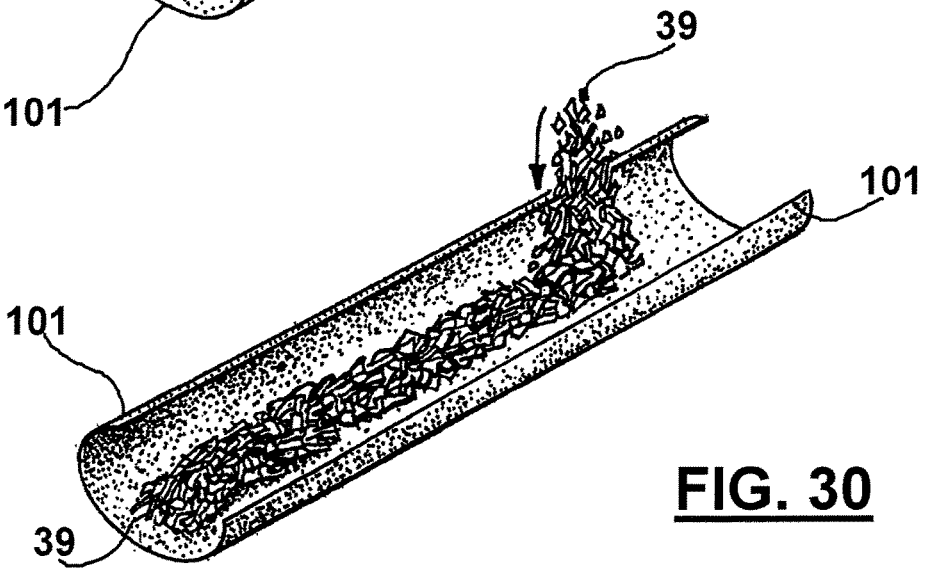
FIG. 30 shows the step of adding custom tobacco to the interior of one of the removed sheets shown in FIG. 29.

In FIGS. 28-30, all three layers (101, 114, and 115) have been removed leaving only finished smoking article 110. Each layer can be removed by pulling on its respective string or cord as indicated by FIG. 27 for string 102.

In one embodiment smoking article 110 can include perforation line 112.

In one embodiment each layer (101 or 114 or 115) can be filled with a smokers custom tobacco filler material. Thus, three cigars can made one each from layer 101, 114, and 115.

Figure 31:
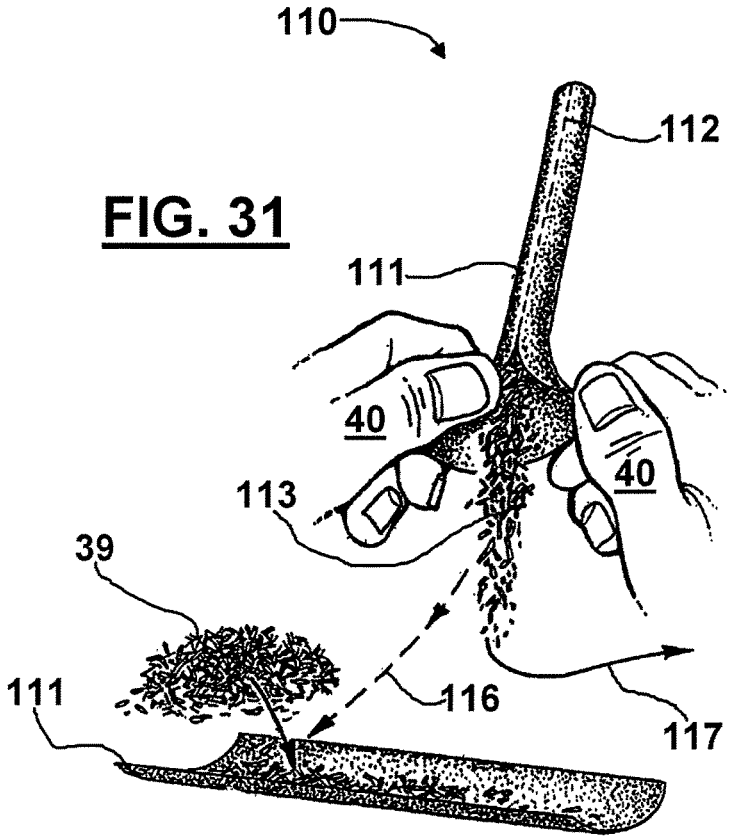
FIG. 31 shows the finished cigar of FIG. 28 having its perforation being opened to provide access to the original tobacco filler and then the step of a custom tobacco filler being placed in the shell having a memory for rolling and creation of a custom cigar.

FIG. 31 shows smoking article 110 being opened along serration 112, and the filler material 113 discharged as indicated by arrow 117. Arrow 116 illustrates placement of layer 111 to receive filler 39, a smokers custom tobacco filler material.

Figure 32:
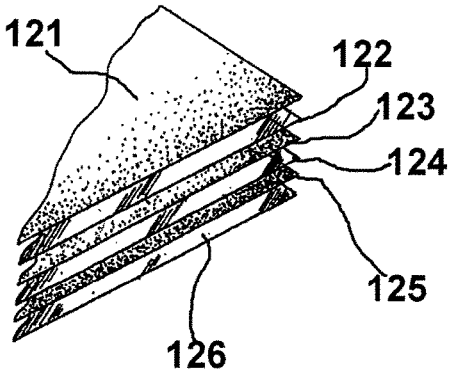
FIGS. 32 through 34 illustrate the steps of creating a multi sheet cone which can be packaged for sale using the packaging of any of the other embodiments (e.g., tube, pouch, interior support tapered or cylindrical), where one or more intermediate separating sheets can be placed between the smokable sheets of homogenized tobacco.
Figure 33:
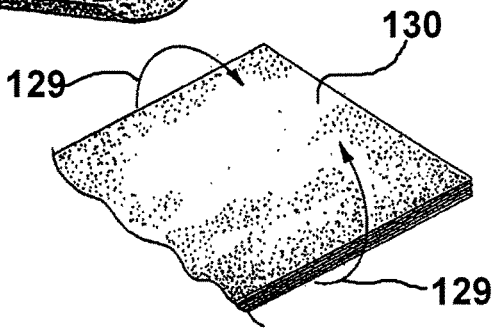
Figure 34:
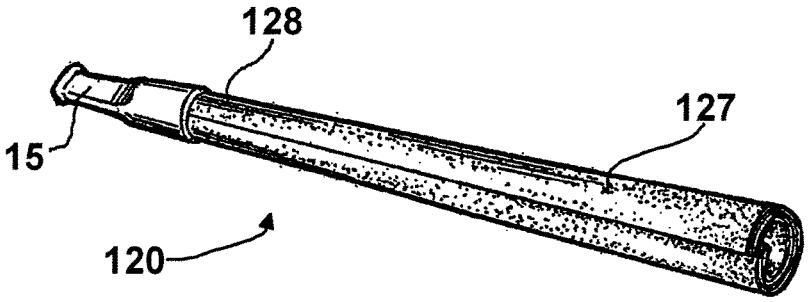

In FIGS. 32-34, a cigar 120 can be fabricated of multiple tobacco layers 121, 123, 125 separated by separating sheets 122, 124, 126. Sheets 122, 124, 126 can be smokable materials, such as homogenized tobacco sheet, or natural leaf, or some combination of either. Between the smokable sheets can be placed non-smokable intermediate sheets (such as plastic or polymer sheets) to prevent the sheets from sticking together. A single multiple sheet cone can be formed by conically rolling (see FIGS. 33 and 34) the sheets together and placing them in a tip 15. This combination of layers 130 are formed or rolled (see arrows 129) into a cone, conically shaped or frusto-conically shaped member (127 and attached to a tip or mouthpiece 15 by threading proximal tip 128 into socket 117 of tip 15. This multiple sheet embodiment can be packaged for sale in packaging such as foil pouches, tubes, or other commercial packaging.

The following is a list of parts and materials suitable for use in the present invention.

PARTS LIST

Part Number Description

10 smoking article
11 storage tube or container
12 cap/closure
13 interior
14 narrowed section
15 tip or mouthpiece
16 distal frusto-conically shaped section
17 socket
18 internal thread
19 proximal section
20 airway
21 shoulder
22 stop
23 arrow
24 first frusto-conically shaped layer or cone
25 second frusto-conically shaped layer or cone
26 rod or straw
27 edge
28 edge
29 proximal end
30 distal opening
31 proximal end
32 distal opening
33 proximal opening
34 smaller diameter opening
35 arrow (dimension A)
36 larger diameter opening
37 arrow (dimension B)
38 package of tobacco
39 tobacco filler material
40 smoker
41 arrow
42 arrow
43 twisted closure
44 perforated line/perforation
45 interior supporting member
46 container/pouch
47 flat end
48 circular opening
49 interior
50 smoking article
51 storage tube
52 cap/closure
53 interior
54 narrowed section
55 smoking article
56 spirally wrapped layer/cone
57 distal end portion
58 proximal end portion
59 arrow (dimension A)
60 closure tab/connection tab
61 arrow
62 arrow
63 arrow (dimension B)
64 arrow

65 arrow
66 arrow
67 smoking article
68 spirally wrapped layer/cone
69 distal end portion
70 proximal end portion
71 arrow (dimension A)
72 connection flap
73 arrow
74 arrow
75 arrow (dimension B)
76 arrow
77 arrow
78 arrow
80 smoking article
81 cone/conically shaped layer
82 proximal end
83 distal end
84 support member
85 dimension arrow
86 arrows
87 perforation
88 dimension arrow
90 smoking article
91 burstable flavor element
92 tobacco layer
93 tobacco filler
94 end
95 end
100 smoking article
101 tobacco layer
102 string
103 arrow
104 longitudinal edge
105 longitudinal edge
106 tobacco filler
107 second tobacco layer
108 third tobacco layer
110 smoking article
111 tobacco layer
112 serrated line
113 tobacco filler
114 tobacco layer
115 tobacco layer
116 arrow
117 arrow
120 smoking article/cigar
121 tobacco layer
122 separating layer/sheet
123 tobacco layer
124 separating layer/sheet
125 tobacco layer
126 separating layer/sheet
127 multi sheet cone
128 proximal tip
129 arrows
130 combination of layers
200 arrow All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A method of constructing a cigar, comprising the steps of:

(a) providing a plurality of nested conically shaped tubes that form a nested stack of shaped tubes, the nested stack having opposed first and second stack ends, each conically shaped tube in the nested stack being formed of smokable material and each having proximal and distal cone end portions with cone interiors between their respective proximal and distal cone end portions;

(b) a conical support nested in the cone interior of a first conically shaped tube located at the second end of the nested stack;

(c) a supporting receiver having an opening for receiving the proximal end of a second conically shaped tube located at the first end of the nested stack; and (d) packaging for sale the nested stack of conically shaped tubes with the nested stack having the receiver and the conical support, and the plurality of nested conically shaped tubes being unfilled with a smokable material.

2. The method of claim 1, wherein in step "b", the conical support has a conical support taper, the first conically shaped tube has a tube taper and the conical taper is substantially the same as the tube taper.

3. The method of claim 1, wherein a plurality of the nested conical shaped tubes are reinforced internally with the conical support.

4. The method of claim 1, wherein the conical support is conically shaped with a conical support interior.

5. The method of claim 1, wherein the conical support has a conical support interior and a rod is placed in the conical support interior.

6. The method of claim 1, wherein in step "d", the nested stack of conically shaped tubes are packaged in a container.

7. The method of claim 6, wherein the container has a container interior and an openable top, and the nested stack of conically shaped tubes are packaged in the container interior.

8. The method of claim 1, wherein in step "d", the nested stack of conically shaped tubes are packaged in a package.

9. The method of claim 1, wherein in step "c", the receiver is a mouthpiece and the opening is internally threaded.

10. He method of claim 1, wherein in step "c", the receiver is a tip.

11. The method of claim 1, wherein at least one of the plurality of nested conically shaped tubes has a closure tab that closes the tube with adhesive on the tab, and further comprising opening the tab to expand the tube and then closing the tube using the closure tab.

12. The method of claim 1, wherein is step "a" the smokable material is tobacco.

13. A method of constructing a cigar, comprising the steps of:

(a) providing a plurality of conically shaped tubes that form a nested stack of shaped tubes, the nested stack having opposed first and second nested stack ends, each conically shaped tube in the nested stack being formed of smokable material and each having proximal and distal cone end portions with cone interiors between their respective proximal and distal cone end portions;

(b) a conical support nested in the cone interior of a first conically shaped tube of the nested stack of shaped tubes, the first conically shaped tube being located at the second end of the nested stack;

(c) a supporting receiver for receiving the proximal end of a second conically shaped tube of the nested stack of shaped tubes, the second conically shaped tube being located at located at the first end of the nested stack; and (d) packaging for sale the nested stack of conically shaped tubes, the receiver, and the conical support, wherein the plurality of nested conically shaped tubes are not filled with a smokable filler.

14. The method of claim 13, wherein in step "b", the conical support has a conical support taper, the first conically shaped tube has a tube taper and the conical taper is substantially the same as the tube taper.

15. The method of claim 13, wherein a plurality of the nested conical shaped tubes are reinforced internally with the conical support.

16. The method of claim 13, wherein the conical support is conically shaped with a conical support interior.

17. The method of claim 13, wherein in step "d", the nested stack of conically shaped tubes are packaged in a container.

18. The method of claim 17, wherein the container has a container interior and an openable top, and the nested stack of conically shaped tubes are packaged in the container interior.

19. The method of claim 13, wherein in step "d", the nested stack of conically shaped tubes are packaged in a package.

20. The method of claim 13, wherein in step "c", the receiver is a mouthpiece and the opening is internally threaded.

21. The method of claim 13, wherein in step "c", the receiver is a tip.

22. The method of claim 13, wherein at least one of the plurality of nested conically shaped tubes has a closure tab that closes the tube with adhesive on the tab, and further comprising opening the tab to expand the tube and then closing the tube using the closure tab.

23. The method of claim 13, wherein is step "a" the smokable filler is tobacco.

24. A method of constructing a cigar, comprising the steps of:

(a) obtaining (i) a plurality of nested conically shaped tubes that form a nested stack of shaped tubes, the nested stack having opposed first and second stack ends, each conically shaped tube in the nested stack being formed of smokable material and each having proximal and distal cone end portions with cone interiors between their respective proximal and distal cone end portions;

(ii) a conical support nested in the cone interior of a first conically shaped tube located at the second end of the nested stack;

(iii) a supporting receiver having an opening for receiving the proximal end of a second conically shaped tube located at the first end of the nested stack; and (iv) the nested stack of conically shaped tubes being packaged for sale in a container;

(b) opening the container and removing at least one of the nested conically shaped tubes from the container; and (c) filling the at least one removed conically shaped tube with a smokable filler.

25. The method of claim 24, wherein at least one tube has a closure tab that closes the tube with adhesive on the tab, and between steps "b" and "c" further comprising the step of opening the tab to expand the tube and then closing the tube using the closure tab.

26. The method of claim 24, wherein is step "a" the smokable material is tobacco.

* * * * *